US007036781B1

(12) United States Patent
Bothe

(10) Patent No.: US 7,036,781 B1
(45) Date of Patent: May 2, 2006

(54) CONNECTING UNIT FOR THE ANGLE-ADJUSTABLE CONNECTION OF AT LEAST TWO LOUDSPEAKER ENCLOSURES, AND CORRESPONDINGLY CONNECTED LOUDSPEAKER ENCLOSURES

(75) Inventor: Frank Bothe, Backnang (DE)

(73) Assignee: D&B Audiotechnik AG, (DE)

( * ) Notice: Subject to any disclaimer, the term of this patent is extended or adjusted under 35 U.S.C. 154(b) by 0 days.

(21) Appl. No.: 09/574,783

(22) Filed: May 19, 2000

(30) Foreign Application Priority Data

Apr. 7, 2000 (DE) ..... 200 06 335 U

(51) Int. Cl.
*E04G 3/00* (2006.01)

(52) U.S. Cl. ..... 248/291.1; 248/282.1; 248/284.1; 312/111.5; 381/335; 381/336; 16/235; 16/247

(58) Field of Classification Search ..... 403/43, 403/48, 68; 312/111.5, 246, 198, 248, 201; 248/291.1, 282.1, 284.1, 324, 323, 317, 299.1, 248/286.1, 298.1; 381/335–336, 332, 188, 381/87, 88, 205, 90; 16/235, 247, 254, 261, 16/262, 348

See application file for complete search history.

(56) References Cited

U.S. PATENT DOCUMENTS

| | | | | |
|---|---|---|---|---|
| 1,897,400 | A * | 2/1933 | Scofiled | 248/598 |
| 4,255,180 | A * | 3/1981 | Wolfe | 65/182.1 |
| 4,340,196 | A * | 7/1982 | Eldred | 244/1 R |
| 5,154,384 | A * | 10/1992 | Owens | 248/220.1 |
| 5,266,751 | A | 11/1993 | Taguchi | 181/144 |
| 5,282,410 | A * | 2/1994 | Sanderson | 89/37.16 |
| 5,350,327 | A * | 9/1994 | Self et al. | 440/66 |
| 5,899,430 | A * | 5/1999 | Malakates et al. | 248/489 |

FOREIGN PATENT DOCUMENTS

| | | | |
|---|---|---|---|
| JP | 7307991 | 11/1995 | 1/40 |
| JP | 8199597 | 8/1996 | 29/2 |
| JP | 9291684 | 11/1997 | 15/0 |

* cited by examiner

*Primary Examiner*—Kimberly Wood
(74) *Attorney, Agent, or Firm*—Ostrolenk, Faber, Gerb & Soffen, LLP

(57) ABSTRACT

The invention relates to a connecting unit for the angle-adjustable connection of at least two loudspeaker enclosures. There are provided a first supporting part (13), which can be assigned to one loudspeaker enclosure (11), and a second supporting part (14), which can be assigned to the other loudspeaker enclosure (12), it being the case that the supporting parts (13, 14) are connected to one another in an articulated manner, and the angle position assumed in each case between the two supporting parts (13, 14) is fixed in an adjustable manner by an angle-position device (15) which acts in the manner of a turnbuckle.

7 Claims, 3 Drawing Sheets

CONNECTING UNIT FOR THE ANGLE-ADJUSTABLE CONNECTION OF AT LEAST TWO LOUDSPEAKER ENCLOSURES, AND CORRESPONDINGLY CONNECTED LOUDSPEAKER ENCLOSURES

BACKGROUND OF THE INVENTION

The invention relates to a connecting unit for the angle-adjustable connection of at least two loudspeaker enclosure according to via an articulated connection and means for adjusting the angle of articulation.

The invention also relates to loudspeaker enclosures which are connected to one another by means of a corresponding connecting unit.

Connecting units of the type mentioned in the introduction are already known. The disadvantage is that the only way in which an angle adjustment of, for example, two interconnected loudspeaker enclosures can be carried out by means of a known connecting unit is inconvenient in handling terms since the connecting unit has to be adjusted such that it is possible for at least one loudspeaker enclosure to move freely for the angle adjustment thereof. As a result of this capacity for free movement of the loudspeaker enclosure which is to be repositioned, the latter has to be retained in the desired operating position, if appropriate, by a person assigned specifically to this task, while, at the same time, the connecting unit is fixed by a further person, who is assigned specifically to that task. In particular in the case of loudspeaker enclosures of relatively large dimensions, two people are necessary for the purposes of positioning at least one loudspeaker enclosure and of fixing the connecting unit. For the purpose of quickly and correctly adjusting the angle of one or more loudspeaker enclosures, it may be necessary to have an additional, third person, who monitors the respective angle adjustment from an observation point at a distance from the loudspeaker enclosures. This means that quick and correct angle adjustment of at least two interconnected loudspeaker enclosures by means of a known connecting unit can only be carried out disadvantageously, using a comparatively high number of operating staff and/or in a manner which is inconvenient in handling terms.

SUMMARY OF THE INVENTION

The object of the invention is to provide a connecting unit of the type mentioned in the introduction by means of which quick, secure and correct angle adjustment of at least two interconnected loudspeaker enclosures is possible in an easy-to-handle and reliable manner.

In order to achieve this object, a connecting unit comprising a first supporting part, which can be assigned to one loudspeaker enclosure, and a second supporting part, which can be assigned to the other loudspeaker enclosure. The supporting parts are connected to one another in an articulated manner, and the angle position assumed in each case between the two supporting parts is fixed in an adjustable manner by means of an angle-position device which acts in the manner of a turnbuckle. A connecting unit designed in this way makes possible an intended angle adjustment of at least two interconnected loudspeaker enclosures on account of the articulation connection between the two supporting parts. The angle-position device, which acts in the manner of a turnbuckle, ensures, during the angle adjustment of one or more loudspeaker enclosures, that the latter always assume a stable angle position. The angle position of the corresponding loudspeaker enclosures, as it being possible for the angle position to be adjusted in a variable manner by means of the angle-position device, is stable at all the adjustable angle-adjustment points since the angle-position device operates essentially without play. As a result that, before, during and after the angle adjustment of the loudspeaker enclosures, the latter are always fixed in position in relation to one another. This ensures variable adjustability of loudspeaker enclosures by means of the angle-position device. At the same time, the situation where a disadvantageous, unstable angle position of one or more loudspeaker enclosures arises is reliably ruled out. An angle adjustment of two interconnected loudspeaker enclosures by means of the angle-position device, which acts in the manner of a turnbuckle, can be carried out in an easy-to-handle manner by a single person, the only requirement being for this person to actuate the angle-position device, rather than there being any additional need—as in the prior art—for, if appropriate, a further person to ensure stable positioning of one or more loudspeaker enclosures which are to be angle-adjusted. It is particularly advantageous that the subject-matter of the invention allows at least two loudspeaker enclosures to be suspended in a very straightforward manner. This is because the connecting unit fixes the two loudspeaker enclosures relative to one another, and the loudspeaker enclosure fixed in this way may preferably be accommodated in a precise position in space merely by way of a suspension means or the like. In this case, the suspension means acts on any desired point of the unit comprising the two loudspeaker enclosures and the connecting unit. Provision is preferably made to provide a fastening unit in order to give a fastening point for the unit as a whole. The vertical alignment of the loudspeaker enclosures is preferably carried out by means of the connecting unit according to the invention. The horizontal alignment of the loudspeaker enclosures takes place by means of separate elements, independently of the connecting unit.

The angle-position device is advantageously operatively connected on the end sides in each case to one of the two supporting parts. This allows the connecting unit to be realized as a user-friendly, compact and preassembled subassembly since the two supporting parts can be operatively connected to the angle-position device even before they are fastened on the associated loudspeaker enclosures.

The carrying parts are preferably fastened in each case on a support element which retains a loudspeaker enclosure. This allows, on the one hand, reliable and stable fixing, particularly of comparatively large and/or heavy loudspeaker enclosures and, on the other hand, preassembly of the connecting unit with the corresponding support elements, since the loudspeaker enclosures may also be fastened on the associated support element at a later point in time.

The supporting parts are advantageously two components of the same design. Since the two supporting parts, which are connected to one another in an articulated manner, have the same function, namely of ensuring secure fastening of the connecting unit on the corresponding loudspeaker enclosures and/or the associated support elements and, at the same time, of allowing angle adjustment of one or more loudspeaker enclosures, the two supporting parts may be designed as identical components. This ensures a reduction in production outlay and relatively straightforward assembly and/or preliminary assembly.

According to a preferred embodiment, the angle-position device has an adjustment sleeve, containing an internal left-handed thread at one end and an internal right-handed thread at the other end. A respective threaded bolt which is operatively connected to the adjustment sleeve on the end sides, has a corresponding external thread and is fastened, by way of its end spaced apart from the adjustment sleeve, on the associated supporting part in an articulated manner and such that it is rotationally fixed in relation to its longitudinal axis. An angle-position device which is designed in this way, and acts in the manner of a turnbuckle, makes possible, by straightforward rotation of the adjustment sleeve about its longitudinal axis, reliable and easy-to-handle angle adjustment, which is stable in any angle position, of at least two loudspeaker enclosures which are operatively connected by means of the connecting unit. In this case, the stability is maintained in all angle positions of the loudspeaker enclosures on account of the permanent thread engagement between the respective threaded bolt and the adjustment sleeve.

For the purpose of arresting the angle-position device, there is advantageously provided in each case one lock nut which can be rotatably adjusted on the associated threaded bolt and can be brought into abutment with the adjustment sleeve on the end side. A lock nut which is brought into abutment with the adjustment sleeve on the end side in each case prevents undesired angle adjustment of a corresponding loudspeaker enclosure by means of the adjustment sleeve rotating about its longitudinal axis such that the threaded bolts are displaced longitudinally into the adjustment sleeve. Such a rotary movement of the adjustment sleeve is only possible when the two lock nuts are located, on the corresponding threaded bolt, in a position in which they are spaced apart from the associated end of the adjustment sleeve.

According to a preferred embodiment, on the end side, the supporting parts have in each case one centrally arranged fastening web for the purpose of fastening, in an articulated manner, the associated end of the angle-position device, which end extends, in a longitudinal direction, perpendicularly to an axis of rotation of the supporting parts. This allows a compact configuration of the connecting unit which is favorable in terms of force transmission.

The supporting parts are advantageously of cross-sectionally U-shaped design parallel to their axis of rotation and, in an overlapping region of the corresponding side webs, are operatively connected to one another by means of an articulation bolt arranged coaxially with the axis of rotation. Supporting parts of cross-sectionally U-shaped design are particularly stable against deformation and make it possible, in a comparatively straightforward manner, to produce an articulation connection between the supporting parts in an overlapping region of the corresponding side webs.

The support elements are advantageously of U-shaped design in longitudinal section in each case, and the respective loudspeaker enclosure is fixed in the associated support element in a rotatably adjustable manner. A loudspeaker enclosure can be fixed in a support element in a rotatably adjustable manner, for example, by means of a respective fixing mechanism which operatively connects one leg of the support element to the top side and base side of a loudspeaker enclosure. In this case, the loudspeaker enclosure is thus retained between the two opposite, spaced-apart legs of the support element, it being possible for the loudspeaker enclosure to be rotatably adjusted between the legs.

Further advantageous configurations of the invention can be gathered from the description.

BRIEF DESCRIPTION OF THE DRAWINGS

The invention is explained in more detail hereinbelow by way of an exemplary embodiment with reference to associated drawings, in which.

DESCRIPTION OF A PREFERRED EMBODIMENT

Figure 1:
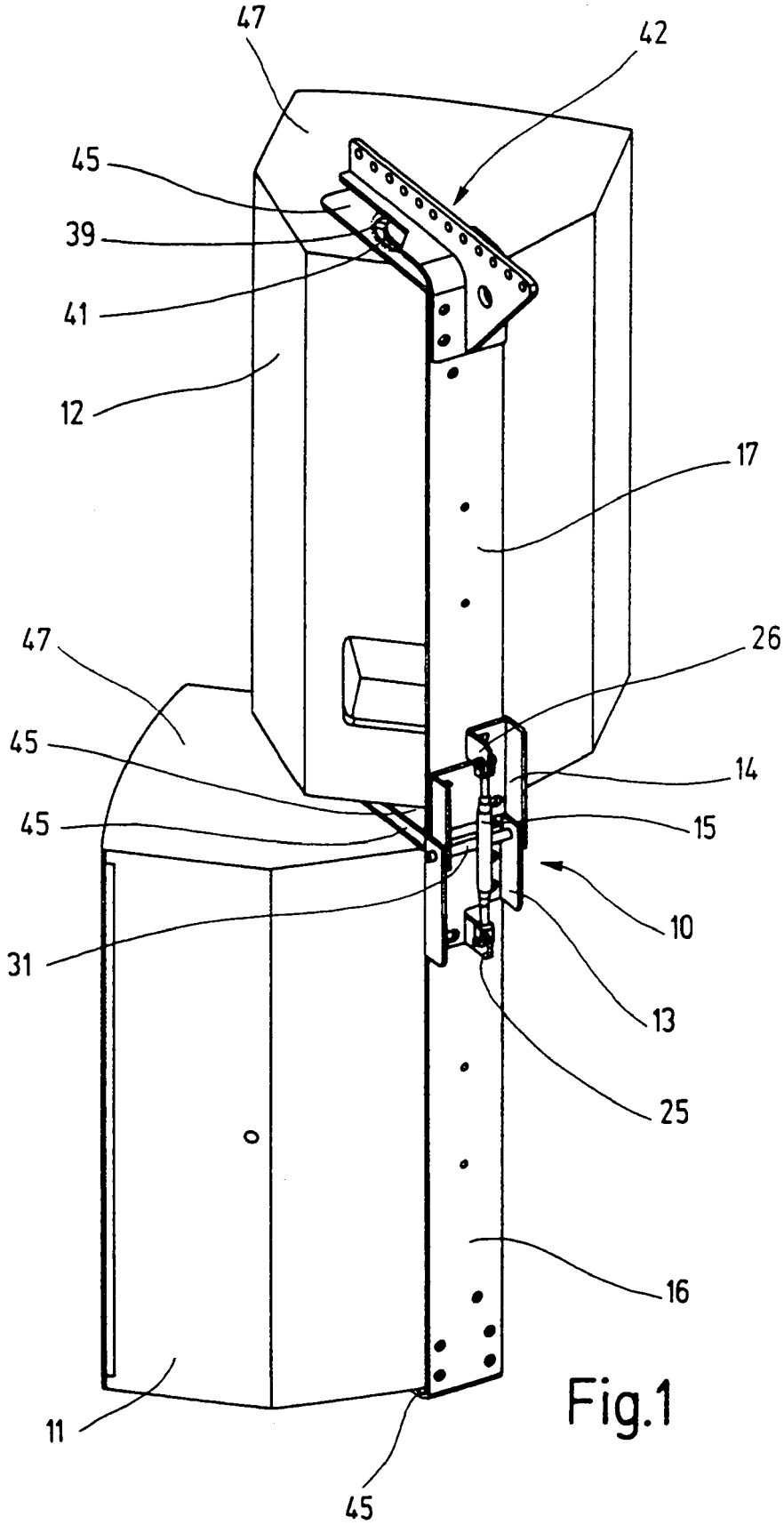
FIG. 1 shows a schematic perspective view of two loudspeaker enclosures in a rectilinear arrangement, said enclosures being connected by a connecting unit according to the invention.
Figure 2:
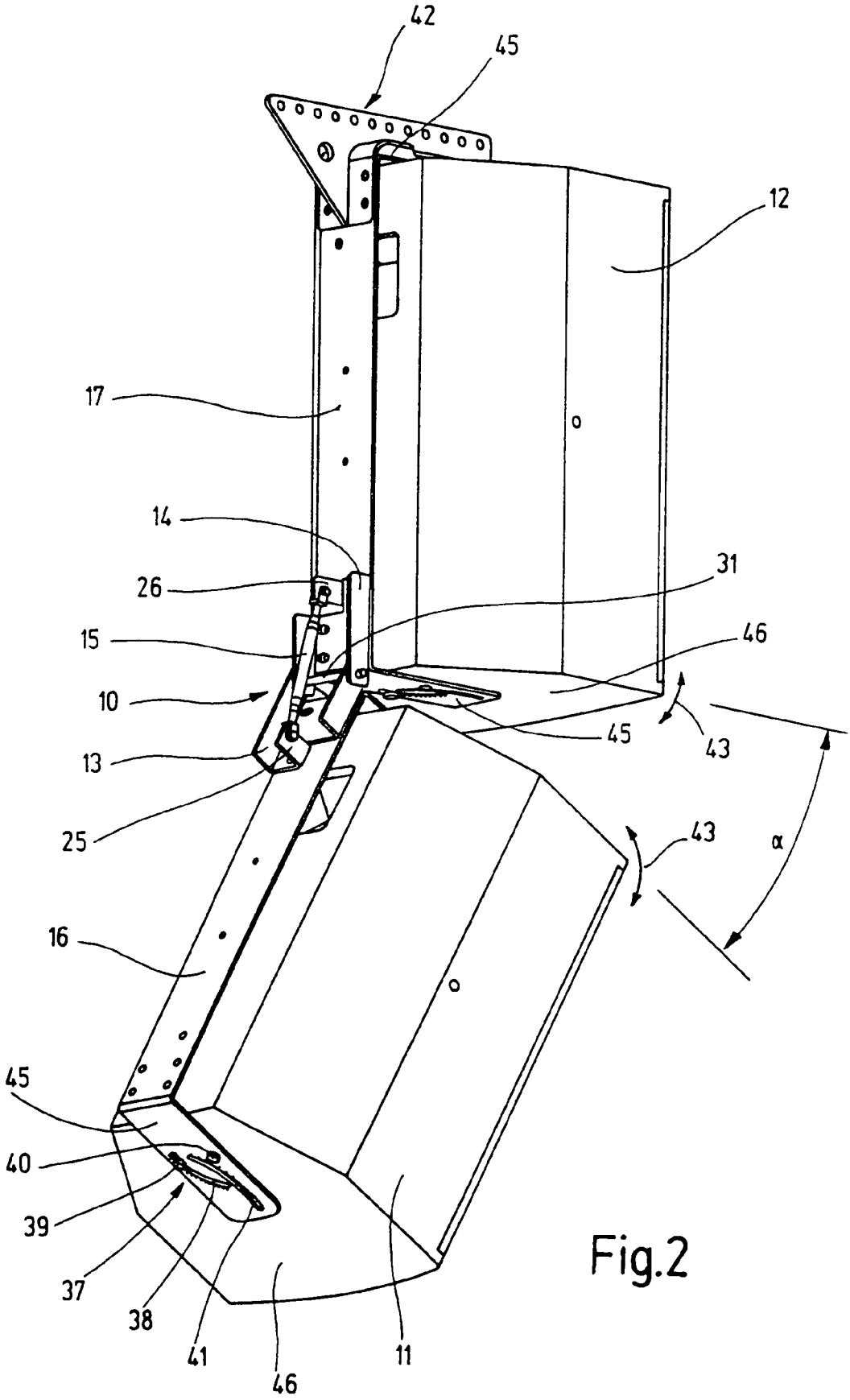
FIG. 2 shows a schematic perspective view of the loudspeaker enclosures according to FIG. 1 in an angle position.

FIGS. 1 and 2 show two vertically arranged loudspeaker enclosures 11, 12 which are each retained in a responsive associated support element 16, 17 and are connected to one another in an angle-adjustable manner by means of a connecting unit 10. The loudspeaker enclosures 11, 12 are each operatively connected, on their top surfaces 46 and on their base surfaces 47, to an associated leg 45 of the support elements 16, 17, each of which is of U-shaped design in longitudinal section. The connecting unit 10 has a first supporting part 13, which is assigned to the top loudspeaker enclosure 11, and a second supporting part 14, which is assigned to the bottom loudspeaker enclosure 12, the supporting parts 13, 14 are connected to one another in an articulated manner. On their outer end sides, the two supporting parts 13, 14 have in each case one centrally arranged (side to side) fastening web 25, 26, on which an angle-position device 15 is fastened in an articulated manner by the associated end of the device 15. The angle-position device 15 is designed as an adjustment device which acts in the manner of a turnbuckle and by means of which the angle position assumed in each case between the two supporting parts 13, 14 can be fixed in an adjustable manner. This means that the angle-position device 15 ensures a stable angle position of the two loudspeaker enclosures 11, 12 in each variably adjustable angle position of the supporting parts 13, 14. By actuation of the angle-position device 15, which acts in the manner of a turnbuckle, the loudspeaker enclosures 11, 12 can be pivoted toward one another and away from one another, in accordance with the double arrows 43, about the longitudinal axis of an articulation bolt 31 which operatively connects the two supporting elements 13, 14. The pivoting action forms an angle position with a pivot angle a between the base surface 47 of the top loudspeaker enclosure 11 and the top surface 46 of the bottom loudspeaker enclosure 12. The angle-position device 15 ensures that, before, during and after the angle adjustment of the loudspeaker enclosures 11, 12, the latter are always in a stable operating position. The angle-position device 15 thus allows variable adjustment of a respectively desired angle position of the two loudspeaker enclosures 11, 12 and, at the same time, ensures that the two loudspeaker enclosures 11, 12 are fixed in a stable position in relation to one another at any point in time, in particular also during angle adjustment of the same.

Figure 3:
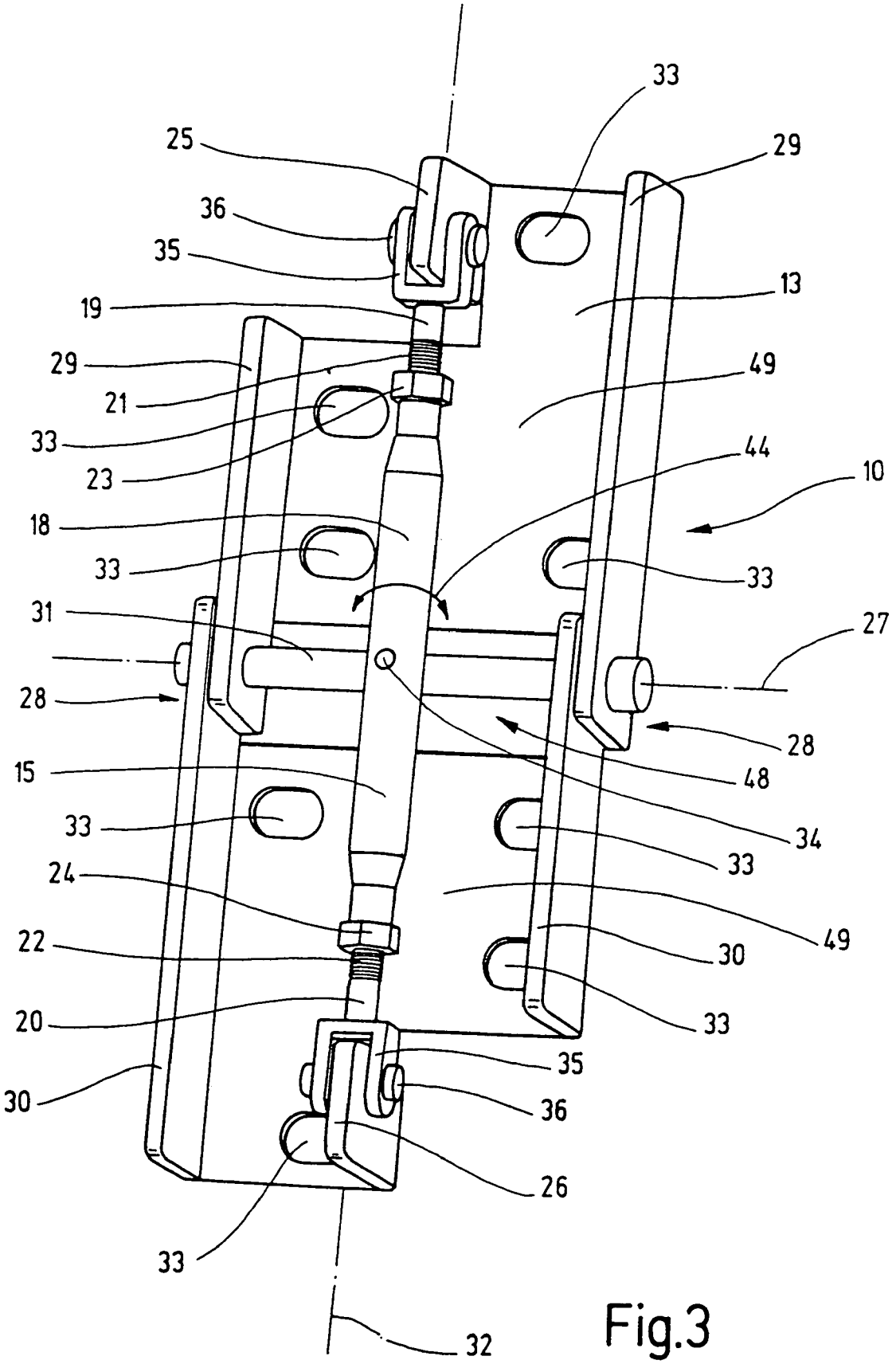
FIG. 3 shows, on an enlarged scale, a schematic perspective view of the connecting unit according to the invention from FIG. 1.

FIG. 3 shows a schematic illustration of the connecting unit 10 from FIGS. 1 and 2 on an enlarged scale. The two supporting parts 13, 14 of the connecting unit 10 are operatively connected to one another by means of the articulation bolt 31 and can be pivoted in a controlled manner about an axis of rotation 27, which is simultaneously the longitudinal axis of the articulation bolt 31, from the rectilinear operating position (angle $\alpha=0$), which is illustrated in FIG. 3, into an angle position according to FIG. 2

(angle $\alpha>0$) and back again into the rectilinear position according to FIG. 3 by means of corresponding actuation of the angle-position device 15. The angle-position device 15 has an adjustment sleeve 18 which contains an internal left-handed thread at one end and an internal right-handed thread at the other end. The adjustment sleeve 18 is operatively connected at the ends in each case to a threaded bolt 19, 20 containing a corresponding external thread 21, 22. The corresponding external threads 21, 22 of two threaded bolts 19, 20 are screwed in the adjustment sleeve 18. The other ends 35 of the bolts, which are spaced from the adjustment sleeve 18 and are of U-shaped or fork-like design, are operatively connected to the fastening webs 25, 26 of the associated supporting part 13 or 14, respectively, by means of a respective articulation bolt 36 for the purpose of forming an articulation connection.

The operative connection between threaded bolt 19 or 20 and the supporting part 13 or 14, respectively, is such that the threaded bolts 19, 20 are fitted in a rotationally fixed manner in relation to a longitudinal axis 32 and, at the same time, can be pivoted in relation to the corresponding supporting part 13, 14, about a longitudinal axis (not illustrated) of the associated articulation bolt 36, by actuation of the angle-position device 15. The adjustment sleeve 18 has at least one actuating opening 34 into which a lever (not illustrated) can be introduced in order to achieve rotate the adjustment sleeve 18 about the longitudinal axis 32, as shown by the double arrow 44, for the purpose of actuating the angle-position device 15. For arresting motion of the adjustment sleeve 18, and thus the angle-position device 15, a respective lock nut 23, 24 can be rotatably adjusted on the associated threaded bolt 19 or 20, respectively, and can be brought into abutment with the adjustment sleeve 18 on the end side.

The supporting parts 13, 14 are of essentially U-shaped design in cross section parallel to their axes of rotation 27 and, in an overlapping region 28 of the corresponding side webs 29, 30, are operatively connected to one another by means of the articulation bolt 31 arranged coaxially with the axis of rotation 27. Located in the overlapping region 28, between the side webs 29 and 30, is in each case one cutout 48, which allows unobstructed pivoting of the supporting part 13, 14 into an angle position (see also FIG. 2). On their speaker housing abutment side 49, each supporting part 13, 14 has a plurality of slot-like through-passage openings for fastening the connecting unit 10 on the support elements 16, 17, for example, by means of a screw-connection. Furthermore, the two supporting parts 13, 14 are designed as identical components, 50 that there are no differences in design between the supporting parts 13, 14. As is illustrated in FIG. 3, the connecting unit 10 may be preassembled in its entirety as a compact subassembly.

For actuating the angle-position device 15, the lock nuts 23, 24 are rotated into a position in which they are spaced apart from the corresponding end of the adjustment sleeve 18. The adjustment sleeve 18 can then be rotated in one of the two directions of rotation, in accordance with double arrow 44, about the longitudinal axis 32 by means of a lever (not illustrated) introduced into the actuating opening 34. Since the adjustment sleeve 18 has an internal left-handed thread at one end and an internal right-handed thread at the other end, its rotary movement causes the threaded bolts 19, 20 to be displaced longitudinally into the adjustment sleeve 18 or away from the same, and thus brings about a pivoting movement of the two supporting parts 13, 14 about the axis of rotation 27. On account of this pivoting movement, the two loudspeaker enclosures 11, 12 (see FIG. 2) can be angle-adjusted in relation to one another in a controlled manner, the two loudspeaker enclosures 11, 12 being fixed in a stable position in relation to one another in any operating position also during the angle-adjustment.

As is illustrated in FIGS. 1 and 2, the legs 45 of the support elements 16, 17 are each provided with two slots 38, 41 which are curved in the form of an arc of a circle. The two slots 38, 41 each serve for fixing the corresponding loudspeaker enclosure 11, 12 in the associated support element 16, 17 in a rotatably adjustable manner. Extending through the slot 38 is a fixing element 39 which is operatively connected to the top surface 46 and/or to the base surface 47 of a loudspeaker enclosure 11, 12 and, in the released operating position, can be displaced along the slot 38. A further fixing element 40 is arranged at a point of rotation of the corresponding loudspeaker enclosure 11, 12. Said point of rotation is the geometrical center point of the circle-arc-shaped slot 38. In an operating state in which they are relieved of stressing, that is to say with the fixing elements 39, 40 and the associated leg 45 of the corresponding supporting element 16, 17 being operatively connected loosely and thus in a manner which allows relative movement (rotation) of the corresponding loudspeaker enclosure in the associated supporting element 16, 17, the fixing elements 39, 40 thus allow rotary adjustment of the associated loudspeaker enclosure 11, 12 about a longitudinal axis (not illustrated) which leads through the fixing elements 40. According to an alternative embodiment, such rotary adjustment of a loudspeaker enclosure can also be achieved by means of the slot 41, which is likewise curved preferably in the form of an arc of a circle and may be operatively connected, for example, to two spaced-apart fixing elements (not illustrated). The support element 17 is additionally provided with a fastening unit 42 by means of which the subassemblies illustrated in FIGS. 1 and 2, and comprising two loudspeaker enclosures 11, 12, two support elements 16, 17 and a connecting unit 10, may be fastened by suspension, for example, on a chain hoist (not illustrated).

The invention claimed is:

1. A connecting arrangement for angle adjustable connection of two loudspeakers, the arrangement comprising:

a first support for a first one of the loudspeakers and a second support for a second one of the loudspeakers;

an articulation connection with a common pivot axis between the first and second supports for enabling an angle of the first and second supports with respect to each other around the common axis to be adjusted;

an angle adjustment device for adjusting the angle of the first and second supports, the angle adjustment device permitting the angle around the axis to be adjusted, and also including a device for fixing the adjusted angle comprising of a turnbuckle;

and further comprising a respective first and second support element for retaining each of the first and second loudspeakers, and each of the support elements being attached to the respective one of the supports of the connecting arrangement;

wherein each support element for a loudspeaker also is U-shaped, including a bottom web and a top web joined by a joining web, and the bottom and top webs holding the loudspeaker between them, the respective support for the support element being attached at the support element; each of the support elements including a connection for connecting to the loudspeaker and for enabling rotation of the loudspeaker with respect to the webs of the respective support element around an axis extending through the webs of the support element enabling further adjustment of the orientation of the loudspeakers.

2. The connecting arrangement of claim 1, where each of the first and second supports are of the same design.

3. The connecting arrangement of claim 1, wherein the angle adjustment device comprises an adjustment sleeve extending in the directions between the first and second supports, the sleeve including opposite ends and a respective internal thread at each of the opposite ends;

a respective threaded bolt received in each of the internal threads, wherein the internal threads in the sleeve and the threads on the respective bolts are so directed that rotation of the sleeve in one direction moves both bolts inward into the sleeve and rotation of the sleeve in the opposite direction moves both bolts outward of the sleeve; each of the bolts having an end away from the sleeve and the end of each bolt is connected with a respective one of the supports in an articulated manner such that rotation of the sleeve moves the bolts and through the articulated connections of the bolts to the supports pivots the supports around the pivot axis.

4. The connecting arrangement of claim 3, wherein the fixing device locks the sleeve against relative rotation with respect to the bolts for setting a selected angle between the supports.

5. The connecting arrangement of claim 4, wherein the fixing device for locking the sleeve against rotation comprises a lock nut on at least one of the bolts and rotatable on the at least one bolt into abutment with the sleeve for preventing further rotation of the sleeve.

6. The connecting arrangement of claim 5, further comprising a respective one of the lock nuts at each of the bolts and each lock nut being rotatable into engagement with the sleeve and preventing rotation of the sleeve with reference to the bolt.

7. The connecting arrangement of claim 6, wherein both supports both have a respective region away from the pivot axis between the supports; a respective fastening web on the region of each of the supports, the web extending in a longitudinal direction perpendicular to the axis rotation between the supports; each bolt being fastened in an articulated manner to the respective web enabling the angle adjustment of the supports.

* * * * *